US005944916A

United States Patent [19]

Chung

[11] Patent Number: 5,944,916

[45] Date of Patent: Aug. 31, 1999

[54] METHOD OF HEAT TREATMENT FOR STEEL

[75] Inventor: Seung Chol Chung, Kyunggi-Do, Rep. of Korea

[73] Assignee: Hyundai Motor Company, Ltd., Seoul, Rep. of Korea

[21] Appl. No.: 08/940,809

[22] Filed: Sep. 30, 1997

[30] Foreign Application Priority Data

Nov. 14, 1996 [KR] Rep. of Korea ..... 96-53913

[51] Int. Cl.[6] ..... C23C 8/22

[52] U.S. Cl. ..... 148/229; 148/233

[58] Field of Search ..... 148/229, 233

[56] References Cited

U.S. PATENT DOCUMENTS 4,913,749 4/1990 Hengerer et al. ..... 148/233
5,595,610 1/1997 Maeda et al. ..... 148/233
5,676,769 10/1997 Kawamura et al. ..... 148/206
5,769,965 6/1998 Liedtke et al. ..... 148/121

FOREIGN PATENT DOCUMENTS 1-176065 7/1989 Japan ..... 148/233

*Primary Examiner*—John Sheehan
*Attorney, Agent, or Firm*—Birch, Stewart, Kolasch & Birch, LLP

[57] ABSTRACT

A method of heat treating steel for use in transmission gears of a vehicle including the steps of carburizing the steel to 900–950° C. quenching the carburizing steel at 830–850° C., reheating the steel with ammonia gas to a temperature of 800–900° C., and fusing the reheated steel at a temperature of 150–230° C. for providing excellent anti-abrasion, contact fatigue strength and blending fatigue strength properties, thereby controlling the quality of steel in a furnace.

6 Claims, 1 Drawing Sheet

METHOD OF HEAT TREATMENT FOR STEEL

BACKGROUND OF THE INVENTION

1. Field of the Invention

The present invention relates to a method of heat treating steel and more particularly, to an improved method of heat treating steel for use in the transmission gear of a vehicle. The method includes the steps of carburizing the steel, quenching the steel, reheating the steel using ammonia gas, and fusing the steel, whereby the resultant steel possesses excellent anti-abrasion properties and good contact fatigue strength and bending fatigue strength properties.

2. Description of Related Art

Various types of methods of heat treatment for steel for use in a transmission gear of a vehicle are known in the art. Generally, the transmission of a vehicle transfers the driving force from the engine to the wheels in various driving states such as vehicle load, the condition of the road and at a desired speed, etc. The transmission includes gears which have various speed reducing ratios for changing the revolution speed and driving torque transmitted to the driving wheels. The gears, including the reverse gear, require excellent anti-abrasion and anti-cracking properties because the gears are engaging each other on almost a continuous basis when driving.

As shown in FIG. 1, the conventional carburizing methods for heat treating steel comprises the steps of (a) carburizing the steel using a carburizing agent at a temperature 900–950° C., (b) quenching the steel by cooling it to a temperature of 830–850° C. and (c) fusing the steel at a temperature of 150–230° C. to provide the steel and transmission gears made therefrom with good anti-abrasion and good contact fatigue strength properties.

In the carburizing step (a) of such a conventional method, the surface of the treated transmission gear becomes a high carbon steel and the internal portion of the steel becomes a low carbon steel. Thus, the gears made from this steel possess only anti-abrasion and contact fatigue strength properties. The quenching step (b) achieves the hardness of the surface of the transmission gears by changing the steel from an austenite state, which melts carbon and other elements in λ steel of the transmission gears, to the martensite state. The fusing step (c) increases the unstable structure-condensing ability, and the expanding and contracting ability.

However, the transmission gears produced by such a conventional method (FIG. 1) suffers from a number of problems. For example, since the treated transmission gears contain a granular carbonate, a large sized crystal grain forms, and austenite is distributed throughout the entire steel in a large amount. Due to these occurrences, transmission gears produced by such a conventional method do not have satisfactory anti-abrasion and contact fatigue strength properties.

In order to solve the above problems, another conventional method of heat treating steel comprises: (a) carburizing the steel by using a carburizing agent at a temperature of 900–950° C. (b) quenching the steel in the presence of ammonia gas to a temperature of 830–850° C., and (c) fusing the steel at a temperature of 150–230° C. (FIG. 2 ). In step (b), the contact fatigue strength can only be improved by retaining elemental nitrogen through the addition of ammonia gas. Thus, the retained austenite maintains its balance.

However, transmission gears produced by such a conventional method (FIG. 2) suffer from a number of problems.

For example it is difficult to obtain excellent anti-abrasion and contact fatigue strength properties, and it is difficult to control the furnace due to the presence of ammonia gas, whereby the product does not have good quality.

SUMMARY OF THE INVENTION

Accordingly, it is an object of the present invention to provide a method of heat treating steel, which eliminates the above problems encountered with respect to conventional methods for the heat-treatment for steel.

Another object of the present invention is to provide a method of heat treating steel for use in transmission gears which comprises the steps of carburizing the steel at a temperature of 900–9500° C., quenching the steel to 830–8500° C., reheating and adding ammonia gas at a temperature of 800–9000°C. and fusing the steel at 150–230° C. whereby the treated steel for use in transmission gears has an excellent anti-abrasion, contact fatigue strength and bending fatigue strength properties.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the at from this detailed description.

Briefly described, the present invention is directed to a method of heat treating steel for use in transmission gears of a vehicle including the steps of carburizing the steel at 900–950° C., quenching the carburized steel to 830–850° C., reheating the steel with ammonia gas to a temperature of 800–900° C., and fusing the reheated steel at a temperature of 150–230° C. The resulting steel provides excellent anti-abrasion, contact fatigue strength and blending fatigue strength properties, thereby controlling the quality of steel in a furnace.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
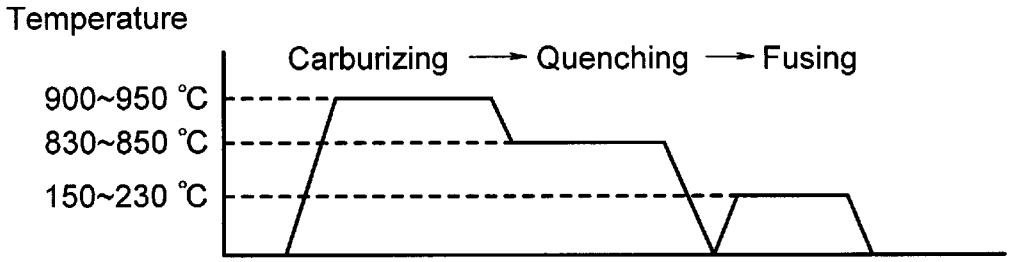
FIG. 1 CONVENTIONAL ART
FIG. 1 is a graph showing a conventional method of heat treating steel for use in a transmission gear.
Figure 2:
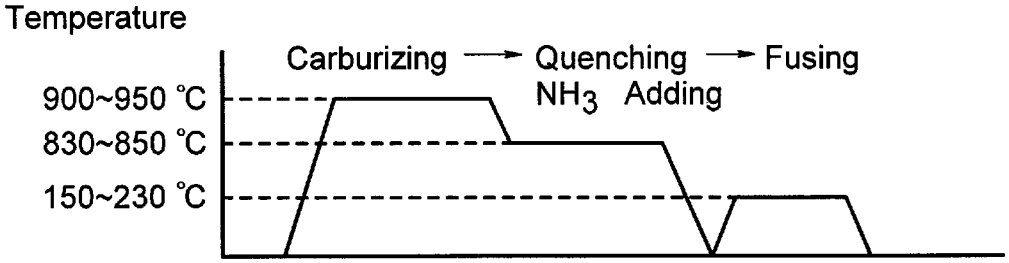
FIG. 2 CONVENTIONAL ART
FIG. 2 is a graph showing a further conventional method of heat treating steel for use in a transmission gear.
Figure 3:
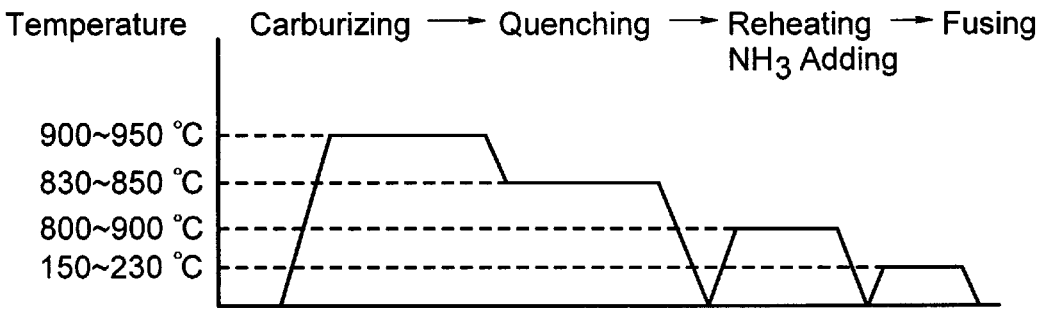
FIG. 3 is a graph showing the heat treatment of steel for use in a transmission gear according to the present invention.

Referring now in detail to the drawings for the purpose of illustrating the preferred embodiments of the present invention, the method of heat treating steel for use in a transmission gear, as shown in FIG. 3, comprises the steps of:

(a) carburizing the steel at a temperature of about 900–950° C., (b) quenching the carburized steel to a temperature of about 830–850° C., (c) reheating the steel at a temperature of about 800–900° C. and in the presence of ammonia to quench the steel, and (d) fusing the resulting steel at a temperature of about 150≠230° C. The present process improves the anti-abrasion, contact fatigue strength and blending fatigue strength.

In the reheating step (c), the reheating temperature is about 800–900° C., preferably about 800–840° C. The ammonia gas ($NH_3$) must be added to the reheating step (c). During this time, ammonia gas is preferably supplied to the furnace in an amount of about 3–8% by volume based on the volume of the furnace for about 0.5–1 hours. The treated steel contains about 25–45% by weight of retained austenite in its surface portion and up to about 5% by weight preferably about 1–5% by weight, more preferably about 5% by weight, of retained austenite in its core portion. Advantageously, the treated steel contains about 30–35% by weight of retained austenite in its surface portion and up to about 5% by weight of retained austenite in its core portion Thus, the treated steel of the present invention is provided with a granular structure thereof by passing it through the reheating step (c) which improves the anti-abrasive and contact fatigue strength properties and also minimizes crystal granule formulation, the improvement in the bending fatigue strength is in inverse proportion to the size of the crystal granules.

The method of heat treating steel provides about 25–45% by weight of retained austenite within about 100 μm from the surface thereof. This can be compared with 10% by weight of retained austenite found in the surface portion of steel treated with conventional methods. Generally, according to the conventional methods, the austenite in the core of the steel does not convert to martensite, so that hardness of the steel decreases since the austenite in the surface and core thereof is about 10% by weight.

However, since the austenite in the core of the steel treated by the present invention is about 5% by weight and about 25–40%, preferably about 30–35% by weight in the surface portion of the steel, the steel according to the method of the present invention provides about a 30% improvement compared with steels treated by conventional methods, in contact and bending fatigue strengths. Particularly, the achievement of excellent contact fatigue strength is caused from effects which scatter contact condensing strength by the austenite, compensate hardness by the austenite, and add the high toughness of the austenite.

The present invention will now be described in more detail in connection with the following examples which should be considered as being exemplary and not limiting the present invention.

EXAMPLE 1

A transmission gear made of Cr-Mo steel, "SCM318H1" which is made in Sammi Special Steel Co., Ltd., Korea, is carburized to 920° C., cool quenched at 850° C., and reheated at 830° C. with ammonia gas for 40 minutes. At this time, the volume of ammonia gas is 5% by volume based on the volume of the furnace. Thereafter, the pretreated transmission gear is continuously fused at 200° C. to produce a treated transmission gear according to the present invention.

EXAMPLE 2

The transmission gear made of Cr-Mo steel, "SCM318H1" which is made in Sammi Special Steel Co, Ltd., Korea, in Example 1 is repeated, the only exception is "SCM722H2-U1" is substituted for "SCM318H1".

Example 2 is the same as Example 1 with the exception that "SCM722H2-U1" is substituted for "SCM318H1".

COMPARATIVE EXAMPLE 1

A transmission gear made of Cr-Mo steel, "SCM318H1" which is made in Sammi Special Steel Co., Ltd., Korea is carburized to 920° C., cool quenched at 850° C., with ammonia gas in an amount of 5% by volume based on the volume of the furnace for 40 minutes, and fused at 200° C. to produce a treated transmission gear.

COMPARATIVE EXAMPLE 2

Comparative Example 2 is the same as Comparative Example 1 with the exception that "SCM722H2-U1" is substituted for "SCM318H1".

The bending fatigue strength, contact fatigue strength, and Beaking hardness of the four treated transmission gears are measured as shown in Table 1. At this time, the bending fatigue strength is measured by an employee of Shimadzu Co., Ltd., Japan, and the contact fatigue strength is measured by an employee of Komatsu Co., Ltd., Japan.

TABLE

| | bending fatigue strength ($Kg \cdot t/mm^2$) | contact fatigue strength ($Kg \cdot t/mm^2$) | Vickers hardness |
|---|---|---|---|
| Example 1 | 90 | 280 | 820 |
| Example 2 | 99.6 | 392 | 850 |
| Comparative Example 1 | 75 | 200 | 700 |
| Comparative Example 2 | 80 | 220 | 750 |

As shown in the Table, the vickers hardness of the transmission gears produced by Examples 1 and 2 increase about 30%, respectively, when compared with that of the transmission gears made by Comparative Examples 1 and 2. Generally, the transmission gears according to the present invention increase about 30% in anti-abrasion ability since an increase of the anti-abrasion ability is proportional to the increase in the beakus hardness. Also, the bending fatigue strength and the contact fatigue strength according to Examples 1 and 2 of the present invention increase about 20% and 40% compared with those of Comparative Examples 1 and 2, according to conventional method, respectively.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A method for the heating treatment of steel which comprises carburizing said steel at a temperature of about 900–950° C. to produce carburized steel, quenching said carburized steel to a temperature of about 830–850°C. to produce a quenched steel, reheating said quenched steel in the presence of ammonia gas at a temperature of about 800–900° C. to produce reheated steel, and fusing said reheated steel at a temperature of about 150–230°C., to produce a steel having excellent anti-abrasion, contact fatigue strength and bending fatigue strength properties.

2. The method of claim 1 wherein the ammonia gas is present in an amount of 3 to 8% by volume based on the total volume to the treatment furnace.

3. The method of claim 2 wherein the reheating of the steel is conducted for about 0.5 to 1 hour.

4.The method of claim 1 wherein the reheating of the steel is conducted in the presence of about 5% by volume of ammonia gas for about 40 minutes.

5. The method of claim 1 wherein the resultant steel contains about 25–40% by weight of retained austenite in the surface portion and up to about 5% by weight of retained austenite in the core portion of the steel.

6. The method of claim 1 wherein the resultant steel contains about 30–35% by weight of retained austenite in the surface portion and up to about 5% by weight in the core portion of the steel.

* * * * *